US009569997B2

(12) United States Patent
An

(10) Patent No.: US 9,569,997 B2
(45) Date of Patent: Feb. 14, 2017

(54) DISPLAY DEVICE INCLUDING DC VOLTAGE CONVERSION CIRCUIT

(71) Applicant: SAMSUNG DISPLAY CO., LTD., Yongin, Gyeonggi-Do (KR)

(72) Inventor: Bo-Young An, Hwaseong-si (KR)

(73) Assignee: SAMSUNG DISPLAY CO., LTD., Yongin, Gyeonggi-Do (KR)

( * ) Notice: Subject to any disclaimer, the term of this patent is extended or adjusted under 35 U.S.C. 154(b) by 118 days.

(21) Appl. No.: 14/561,618

(22) Filed: Dec. 5, 2014

(65) Prior Publication Data

US 2016/0012777 A1 Jan. 14, 2016

(30) Foreign Application Priority Data

Jul. 8, 2014 (KR) ..... 10-2014-0085486

(51) Int. Cl.
*G09G 3/20* (2006.01)

(52) U.S. Cl.
CPC ..... *G09G 3/2092* (2013.01); *G09G 3/20* (2013.01); *G09G 2310/08* (2013.01); *G09G 2330/02* (2013.01)

(58) Field of Classification Search
CPC ..... G09G 3/006; G09G 2320/0242; G09G 2320/0693; G09G 2320/0666; G09G 2320/0673
See application file for complete search history.

(56) References Cited

U.S. PATENT DOCUMENTS

2007/0262935 A1* 11/2007 Shin ..... G09G 3/3291 345/84
2008/0094320 A1* 4/2008 Parikh ..... G09G 3/3233 345/76
2011/0205204 A1 8/2011 Park
2013/0119882 A1 5/2013 Mao et al.
2013/0169517 A1 7/2013 Cho et al.
2014/0022149 A1 1/2014 Kwon et al.

FOREIGN PATENT DOCUMENTS

KR 10-2011-0095592 A 8/2011
KR 10-2013-0076669 A 7/2013
KR 10-2013-0129178 11/2013
KR 10-2014-0010798 A 1/2014

* cited by examiner

*Primary Examiner* — Shaheda Abdin
(74) *Attorney, Agent, or Firm* — Lee & Morse P.C.

(57) ABSTRACT

A display device includes a timing control circuit, a driving circuit, a display panel, and a DC voltage converter. The timing control circuit generates a data signal based on an image signal. The driving circuit generates a first conversion control signal and a second conversion control signal representing a status of the first conversion control signal. The driving circuit generates a driven signal based on the data signal and is powered by a first DC voltage. The display panel is powered by a second DC voltage. The DC voltage converter includes first and second DC voltage conversion circuits. The first DC voltage conversion circuit generates the first DC voltage based on an external voltage. The second DC voltage conversion circuit generates the second DC voltage based on the external voltage. The DC voltage converter executes time-shared control of the first and second DC voltage conversion circuits based on the first and second conversion control signals.

19 Claims, 10 Drawing Sheets

DISPLAY DEVICE INCLUDING DC VOLTAGE CONVERSION CIRCUIT

CROSS-REFERENCE TO RELATED APPLICATION

Korean Patent Applications No. 10-2014-0085486, filed on Jul. 8, 2014, and entitled: "Display Device Including DC Voltage Conversion Circuit," is incorporated by reference herein in its entirety.

BACKGROUND

1. Field

One or more embodiments described herein relate a display device including a DC voltage conversion circuit.

2. Description of the Related Art

A display device generally includes a display panel, a driving circuit, and a DC voltage conversion circuit. The display panel includes a plurality of pixels arranged in a matrix. Each pixel is powered by driving voltages (e.g., ELVDD, ELVSS) from the DC voltage conversion circuit. The driving circuits may also be powered by DC voltages from the DC voltage conversion circuit.

In an organic light emitting display, each pixel includes an organic light emitting diode (OLED). The OLED emits light based on a combination of holes (from an anode to which a positive driving voltage (ELVDD) is applied) and electrons (from a cathode to which a negative driving voltage (ELVSS) is applied) in an organic material layer.

SUMMARY

In accordance with one embodiment, a display device includes a timing control circuit to generate a data signal based on an image signal; a driving circuit to generate a first conversion control signal and a second conversion control signal representing a status of the first conversion control signal, the driving circuit to generate a driven signal based on the data signal, the driving circuit powered by a first DC voltage; a display panel including a plurality of pixels operating based on the driven signal, the display panel powered by a second DC voltage; and a DC voltage converter including a first DC voltage conversion circuit and a second DC voltage conversion circuit, the first DC voltage conversion circuit to generate the first DC voltage based on an external voltage, the second DC voltage conversion circuit to generate the second DC voltage based on the external voltage, the DC voltage converter to execute time-shared control of the first and second DC voltage conversion circuits based on the first and second conversion control signals.

The first DC voltage conversion circuit may modify a level of the first DC voltage based on a number of first continuous pulses in the first conversion control signal when the second conversion control signal is activated. The second DC voltage conversion circuit may modify a level of the second DC voltage based on a number of second continuous pulses in the first conversion control signal when the second conversion control signal is deactivated. The second continuous pulses may be leading continuous pulses in the first conversion control signal after deactivation of the second conversion control signal.

The second DC voltage conversion circuit may extract a command signal of the second DC voltage conversion circuit from a number of third continuous pulses in the first conversion control signal when the second conversion control signal is deactivated. The third continuous pulses may be after the second continuous pulses.

The first DC voltage conversion circuit may be enabled when the second conversion control signal maintains an activation level and the first conversion control signal transfers from a deactivation level to the activation level. The second DC voltage conversion circuit may be enabled when the first conversion control signal maintains an activation level and the second conversion control signal transfers from the activation level to a deactivation level.

The first DC voltage conversion circuit may be disabled when the first conversion control signal maintains a deactivation level and the second conversion control signal maintains an activation level for a time after transition from the deactivation level to the activation level. The second DC voltage conversion circuit may be disabled when the second conversion control signal maintains a deactivation level and the first conversion control signal maintains the deactivation level for a time after transition from an activation level to the deactivation level.

The first DC voltage conversion circuit may modify a level of the first DC voltage based on a number of continuous pulses the first conversion control signal when a predetermined number N of continuous pulses are provided as the second conversion control signal. The second DC voltage conversion circuit may modify a level of the second DC voltage based on the number of the continuous pulses in the first conversion control signal when a predetermined number M of continuous pulses are provided as the second conversion control signal.

The second DC voltage conversion circuit may extract a command signal of the second DC voltage conversion circuit from the number of the continuous pulses in the first conversion control signal when a predetermined number P of continuous pulses are provided as the second conversion control signal, wherein P is different from predetermined numbers N and M. The second DC voltage may include a positive driving voltage and a negative driving voltage.

The display panel may include a first block and a second block, and the second DC voltage may include a first internal DC voltage provided to the first block and a second internal DC voltage provided to the second block.

The first internal DC voltage may include a first positive driving voltage and a first negative driving voltage, and the second internal DC voltage may include a second positive driving voltage and a second negative driving voltage.

The second DC voltage conversion circuit may modify a level of the first internal DC voltage based on a number of first continuous pulses in the first conversion control signal and may modify a level of the second internal DC voltage based on a number of second continuous pulses in the first conversion control signal when the second conversion control signal is deactivated.

The second DC voltage conversion circuit may modify a level of the first internal DC voltage based on a number of first continuous pulses in the first conversion control signal and may modify a level of the second internal DC voltage based on a number of second continuous pulses in the first conversion control signal when a predetermined number M of continuous pulses are provided as the second conversion control signal. Each of the pixels may include an organic light emitting diode.

The driving circuit may include a data driver to generate the driven signal based on the data signal; a power block to provide power to the driving circuit based on the first DC voltage; and a power controller to generate the first and second conversion control signals to reduce power consumption of the display device based on at least one of a characteristic variation of the display panel, a temperature of the display panel, or a luminance of the display panel.

BRIEF DESCRIPTION OF THE DRAWINGS

Features will become apparent to those of skill in the art by describing in detail exemplary embodiments with reference to the attached drawings in which.

DETAILED DESCRIPTION

Figure 1:
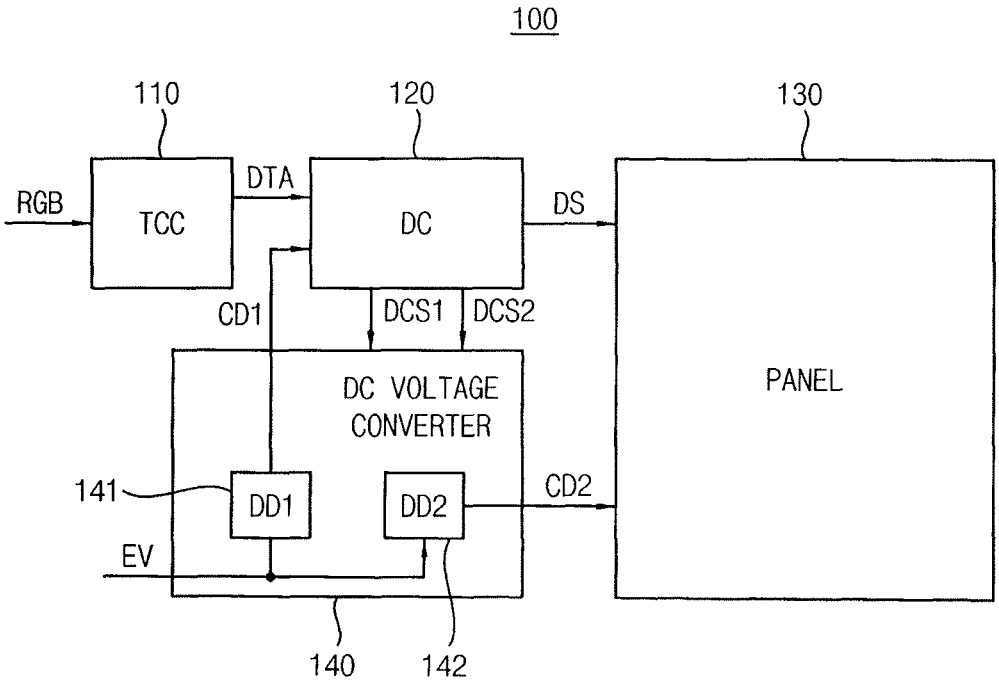
FIG. 1 illustrates an embodiment of a display device including a DC voltage conversion circuit.

Example embodiments are described more fully hereinafter with reference to the accompanying drawings; however, they may be embodied in different forms and should not be construed as limited to the embodiments set forth herein. Rather, these embodiments are provided so that this disclosure will be thorough and complete, and will fully convey exemplary implementations to those skilled in the art. In the drawings, Like reference numerals refer to like elements throughout.

It will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between," "adjacent" versus "directly adjacent," etc.).

FIG. 1 illustrates an embodiment of a display device 100 including a timing control circuit TCC 110, a driving circuit DC 120, a display panel 130, and a DC voltage converter 140. The DC voltage converter 140 includes a first DC voltage conversion circuit DD1 141 and a second DC voltage conversion circuit DD2 142.

The timing control circuit 110 generates a data signal DTA based on an image signal RGB. The driving circuit 120 generates a first conversion control signal DCS1, and a second conversion control signal DCS2 representing a status of the first conversion control signal DCS1. The driving circuit 120 generates a driven signal DS based on the data signal DTA. The driving circuit 120 is powered by a first DC voltage CD1. The driving circuit 120 will be described with the reference to FIG. 7 in detail.

The display panel 130 include a plurality of pixels operating based on the driving signal DS. The display panel 130 is powered by a second DC voltage CD2.

The first DC voltage conversion circuit DD1 generates the first DC voltage CD1 based on an external voltage EV. The second DC voltage conversion circuit DD2 generates the second DC voltage CD2 based on the external voltage EV. The DC voltage converter 140 executes a time-shared control of the first and second DC voltage conversion circuits DD1, DD2 in response to the first and second conversion control signals DCS1, DCS2

At a certain time, the DC voltage converter 140 may control the first DC voltage conversion circuit DD1 in response to the first and second conversion control signals DCS1, DCS2, or may control the second DC voltage conversion circuit DD2 in response to the first and second conversion control signals DCS1, DCS2. The DC voltage converter 140 may not control the first and second DC voltage conversion circuits DD1, DD2 in response to the first and second conversion control signals DCS1, DCS2 at the same time.

FIGS. 2 to 6 illustrate embodiments for operating the DC voltage converter 140. The second DC voltage CD2 may include a positive driving voltage ELVDD and a negative driving voltage ELVSS to operate the display panel 130. Each of the pixels in the display panel 130 may have an organic light emitting diode (OLED).

Figure 2:
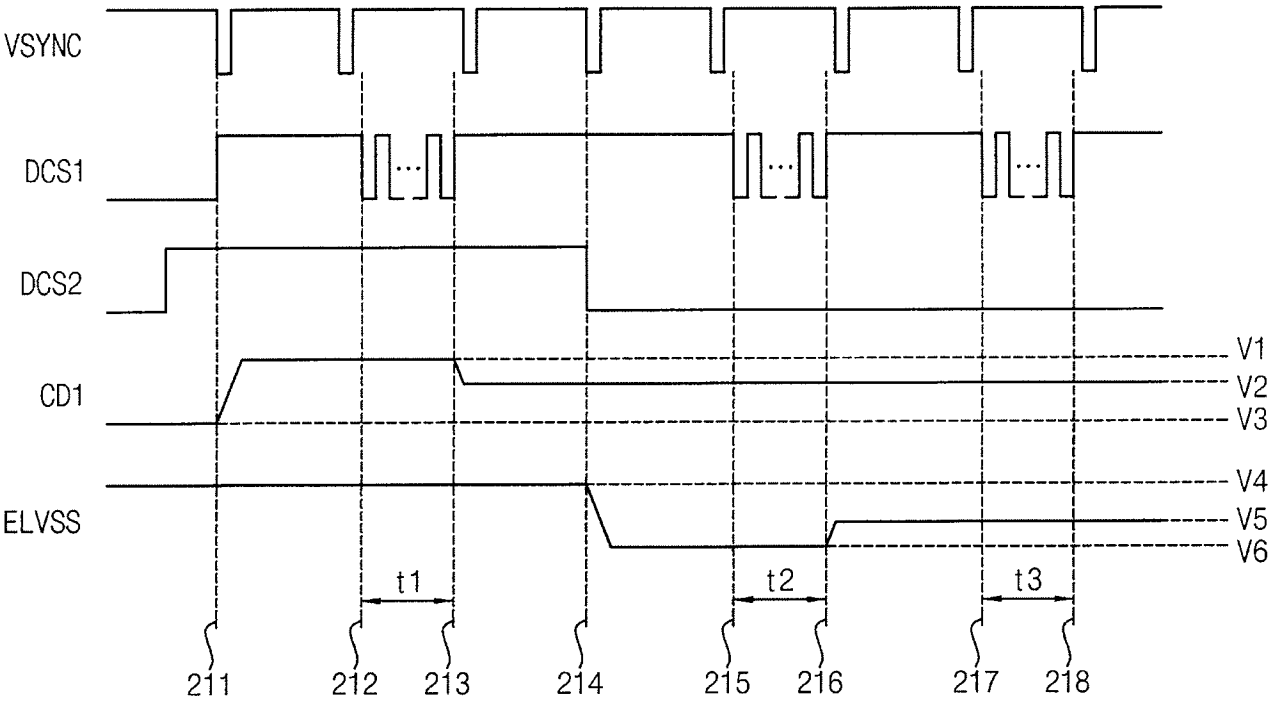
FIG. 2 illustrates an embodiment of a timing diagram for controlling DC voltages of the display device.

FIG. 2 illustrates an example procedure for modifying levels of the first and second DC voltages of the display device 100, and an example procedure of enabling the first and second DC voltage conversion circuits in the display device 100.

Referring to FIG. 2, at a first time point 211 (e.g., a falling edge of the vertical synchronization signal VSYNC), the second conversion control signal DCS2 maintains an activation level, the first conversion control signal DCS1 transfers from a deactivation level to the activation level, and the DC voltage converter 140 may enable the first DC voltage conversion circuit 141. For a certain time from the first time point 211, the first DC conversion circuit 141 may increase a level of the first DC voltage CD1 from a third voltage level V3 to a first voltage level V1.

A first period t1 is from a second time point 212 to a third time point 213. The first DC voltage conversion circuit 141 modifies a level of the first DC voltage CD1 based on a pulse number of first continuous pulses in the first conversion control signal DCS1 within the first period t1, when the second conversion control signal DCS2 is activated.

In one embodiment, the first DC voltage conversion circuit 141 may increase the level of the first DC voltage CD1 according to a predetermined (e.g., large) pulse number of the first continuous pulses. In another embodiment, the first DC voltage conversion circuit 141 may decrease the level of the first DC voltage CD1 according to a predetermined (e.g., large) pulse number of the first continuous pulses. In another embodiment, the level of the first DC voltage CD1 corresponding to the pulse number of the first continuous pulses may be determined using a look-up table (LUT) mapping predetermined pulse numbers and levels of the first DC voltage CD1.

When a voltage level corresponding to the pulse number of the first continuous pulses is the second voltage level V2, for a certain time from the third time point 213, the first DC conversion circuit 141 may decrease the level of the first DC voltage CD1 from the first voltage level V1 to a second voltage level V2.

At a fourth time point 214 (e.g., a falling edge of the vertical synchronization signal VSYNC), the first conversion control signal DCS1 maintains the activation level and the second conversion control signal DCS2 transfers from the activation level to the deactivation level. The DC voltage converter 140 may enable the second DC voltage conversion circuit 142.

In one embodiment, the second DC voltage CD2 may include a positive driving voltage ELVDD and a negative driving voltage ELVSS. For a certain time from the fourth time point 214, the second DC voltage conversion circuit 142 may decrease a level of the negative driving voltage ELVSS from a fourth voltage level V4 to a sixth voltage level V6. Operation of the positive driving voltage ELVDD may be understood based on the operation of the negative driving voltage ELVSS.

A second period t2 is from a fifth time point 215 to a sixth time point 216. The second DC voltage conversion circuit 142 modifies the level of the negative driving voltage ELVSS based on a pulse number of second continuous pulses in the first conversion control signal DCS1 within the second period t2, when the second conversion control signal DCS2 is deactivated.

In one embodiment, the second DC voltage conversion circuit 142 may increase the level of the negative driving voltage ELVSS according to a predetermined (e.g., large) pulse number of the second continuous pulses. In another embodiment, the second DC voltage conversion circuit 142 may decrease the level of the negative driving voltage ELVSS according to a predetermined (e.g., large) pulse number of the second continuous pulses. In another embodiment, the level of the negative driving voltage ELVSS corresponding to the pulse number of the second continuous pulses may be determined using a look-up table (LUT) mapping predetermined pulse numbers and levels of the negative driving voltage ELVSS.

When a voltage level corresponding to the pulse number of the second continuous pulses is a fifth voltage level V5, for a certain time from the sixth time point 216, the second DC conversion circuit 142 may increase the level of the negative driving voltage ELVSS from the sixth voltage level V6 to the fifth voltage level V5.

In one embodiment, the second continuous pulses may be most leading continuous pulses (in a time dimension) in the first conversion control signal DCS1 after deactivation of the second conversion control signal DCS2.

A third period t3 is from a seventh time point 217 to an eighth time point 218. The second DC voltage conversion circuit 142 may extract a command signal of the second DC voltage conversion circuit 142 from a pulse number of third continuous pulses in the first conversion control signal DCS1 within the third period t3. The third continuous pulses may exist after the second continuous pulses in a time dimension.

The command signal of the second DC voltage conversion circuit 142 may be a command signal controlling operation of the second DC voltage conversion circuit 142. In one embodiment, the second DC voltage conversion circuit 142 may increase or decrease amount of output current (or voltage) based on the command signal.

Figure 3:
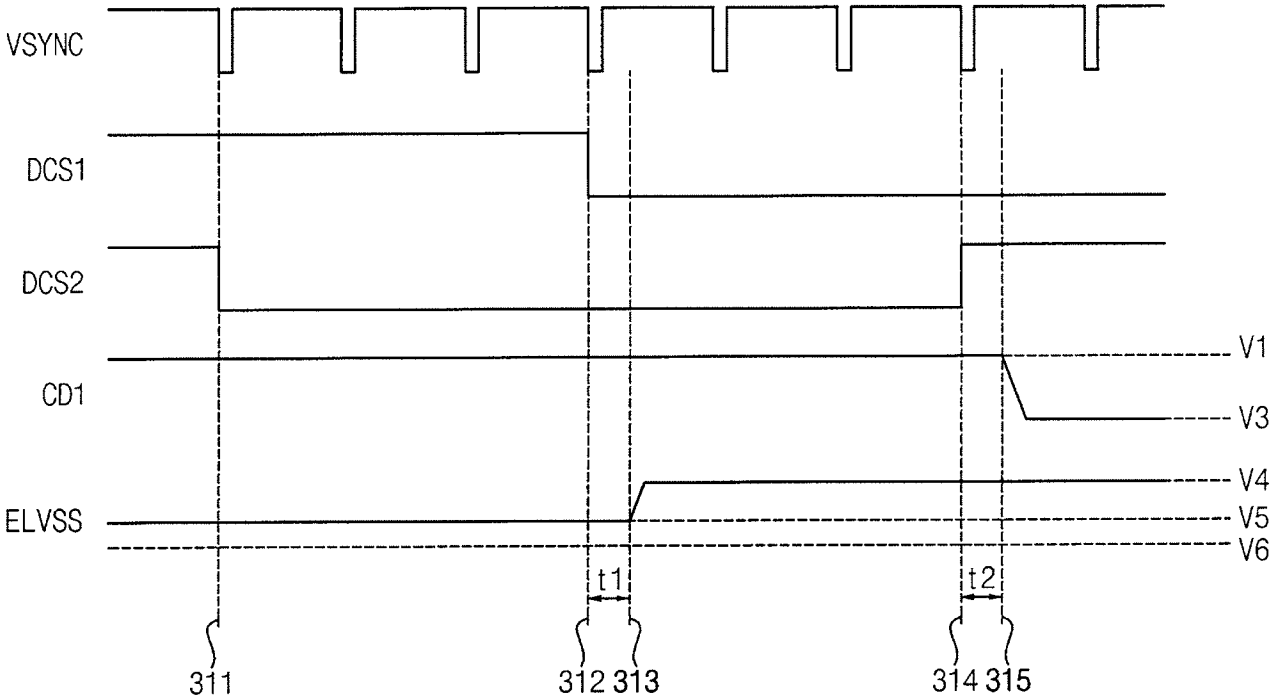
FIG. 3 illustrates an embodiment of a timing diagram for disabling DC voltage conversion circuits.

FIG. 3 illustrates an embodiment of a timing diagram for disabling the first and second DC voltage conversion circuits of the display device 100 of FIG. 1. Referring to FIG. 3, at a first time point 311 (e.g., a falling edge of the vertical synchronization signal VSYNC), the first conversion control signal DCS1 maintains the activation level, the second conversion control signal DCS2 transfers from the activation level to the deactivation level, and the DC voltage converter 140 may enable the second DC voltage conversion circuit 142.

At a second time point 312 (e.g., a falling edge of the vertical synchronization signal VSYNC), the second conversion control signal DCS2 maintains the deactivation level, and the first conversion control signal DCS1 transfers from the activation level to the deactivation level. When the first conversion control signal DCS1 maintains the deactivation level for a certain time t1 from the second time point 312, the DC voltage converter 140 may disable the second DC voltage conversion circuit 142.

At a fourth time point 314 (e.g., a falling edge of the vertical synchronization signal VSYNC), the first conversion control signal DCS1 maintains the deactivation level, and the second conversion control signal DCS2 transfers the deactivation level to the activation level. When the second conversion control signal DCS2 maintains the activation level for a certain time t2 from the fourth time point 314, the DC voltage converter 140 may disable the first DC voltage conversion circuit 141.

Figure 4:
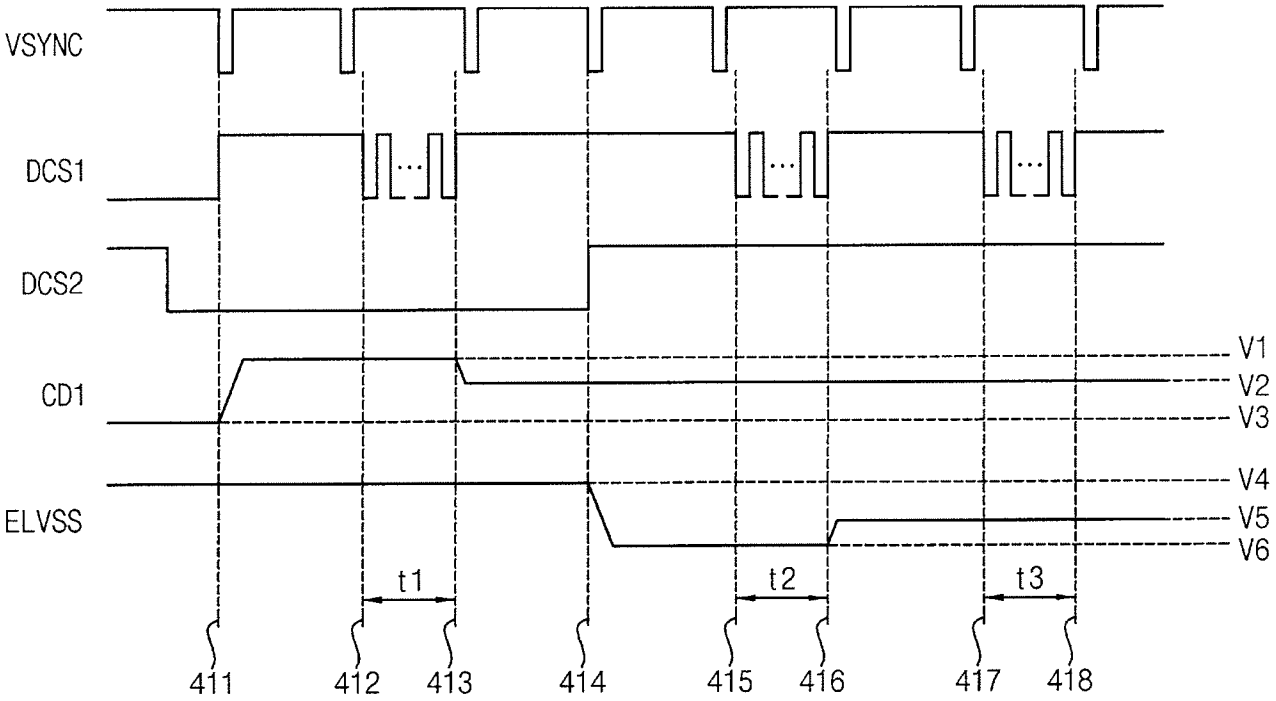
FIG. 4 illustrates another embodiment of a timing diagram for controlling DC voltages of the display device.

FIG. 4 illustrates a timing diagram for modifying levels of the first and second DC voltages of the display device 100 of FIG. 1, and another procedure of enabling the first and second DC voltage conversion circuits in the display device 100 of FIG. 1.

Referring to FIG. 4, at a first time point 411 (e.g., a falling edge of the vertical synchronization signal VSYNC), the second conversion control signal DCS2 maintains the deactivation level, the first conversion control signal DCS1 transfers from the deactivation level to the activation level, and the DC voltage converter 140 may enable the first DC voltage conversion circuit 141. For a certain time from the first time point 411, the first DC conversion circuit 141 may increase a level of the first DC voltage CD1 from the third voltage level V3 to the first voltage level V1.

A first period t1 is from a second time point 412 to a third time point 413. The first DC voltage conversion circuit 141 may modify a level of the first DC voltage CD1 based on a pulse number of first continuous pulses in the first conversion control signal DCS1 within the first period t1, when the second conversion control signal DCS2 is deactivated.

When a voltage level corresponding to the pulse number of the first continuous pulses is the second voltage level V2, for a certain time from the third time point 413, the first DC conversion circuit 141 may decrease the level of the first DC voltage CD1 from the first voltage level V1 to the second voltage level V2.

At a fourth time point 414 (e.g., a falling edge of the vertical synchronization signal VSYNC), the first conversion control signal DCS1 maintains the activation level and the second conversion control signal DCS2 transfers from the deactivation level to the activation level. The DC voltage converter 140 may enable the second DC voltage conversion circuit 142. In one embodiment, the second DC voltage CD2 may include a positive driving voltage ELVDD and a negative driving voltage ELVSS. For a certain time from the fourth time point 414, the second DC voltage conversion circuit 142 may decrease a level of the negative driving voltage ELVSS from the fourth voltage level V4 to the sixth voltage level V6. Operation of the positive driving voltage ELVDD may be understood based on the operation of the negative driving voltage ELVSS.

A second period t2 is from a fifth time point 415 to a sixth time point 416. The second DC voltage conversion circuit 142 may modify the level of the negative driving voltage ELVSS based on a pulse number of second continuous pulses in the first conversion control signal DCS1 within the second period t2, when the second conversion control signal DCS2 is activated.

When a voltage level corresponding to the pulse number of the second continuous pulses is the fifth voltage level V5, for a certain time from the sixth time point 416, the second DC conversion circuit 142 may increase the level of the negative driving voltage ELVSS from the sixth voltage level V6 to the fifth voltage level V5.

In one embodiment, the second continuous pulses may be most leading continuous pulses (in a time dimension) in the first conversion control signal DCS1 after deactivation of the second conversion control signal DCS2.

A third period t3 is from a seventh time point 417 to an eighth time point 418. The second DC voltage conversion circuit 142 may extract a command signal of the second DC voltage conversion circuit 142 from a pulse number of third continuous pulses in the first conversion control signal DCS1 within the third period t3. The third continuous pulses may exist after the second continuous pulses in a time dimension.

Figure 5:
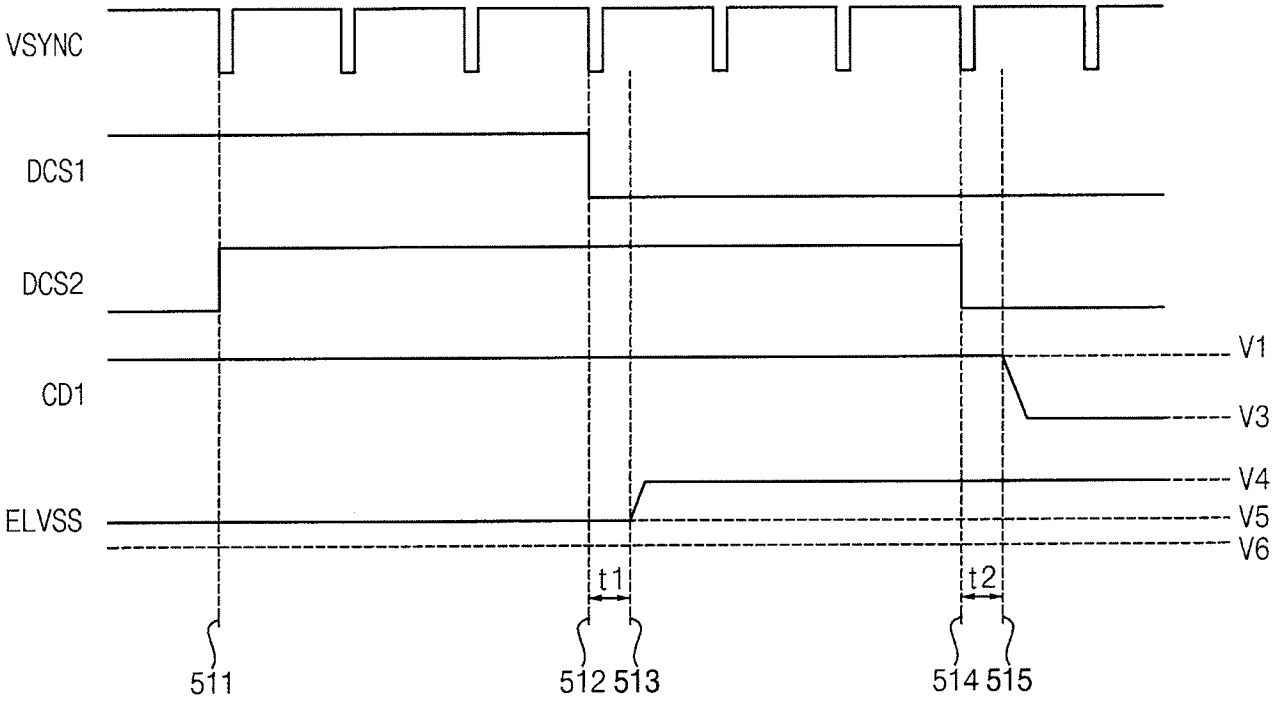
FIG. 5 illustrates another embodiment of a timing diagram for disabling DC voltage conversion circuits.

FIG. 5 illustrates another embodiment of a timing diagram for disabling the first and second DC voltage conversion circuits of the display device 100 in FIG. 1. Referring to FIG. 5, at a first time point 511 (e.g., a falling edge of the vertical synchronization signal VSYNC), the first conversion control signal DCS1 maintains the activation level, the second conversion control signal DCS2 transfers from the deactivation level to the activation level, and the DC voltage converter 140 may enable the second DC voltage conversion circuit 142.

At a second time point 512 (e.g., a falling edge of the vertical synchronization signal VSYNC), the second conversion control signal DCS2 maintains the activation level, and the first conversion control signal DCS1 transfers from the activation level to the deactivation level. When the first conversion control signal DCS1 maintains the deactivation level for a certain time t1 from the second time point 512, the DC voltage converter 140 may disable the second DC voltage conversion circuit 142.

At a fourth time point 514 (e.g., a falling edge of the vertical synchronization signal VSYNC), the first conversion control signal DCS1 maintains the deactivation level, and the second conversion control signal DCS2 transfers the activation level to the deactivation level. When the second conversion control signal DCS2 maintains the deactivation level for a certain time t2 from the fourth time point 514, the DC voltage converter 140 may disable the first DC voltage conversion circuit 141.

Figure 6:
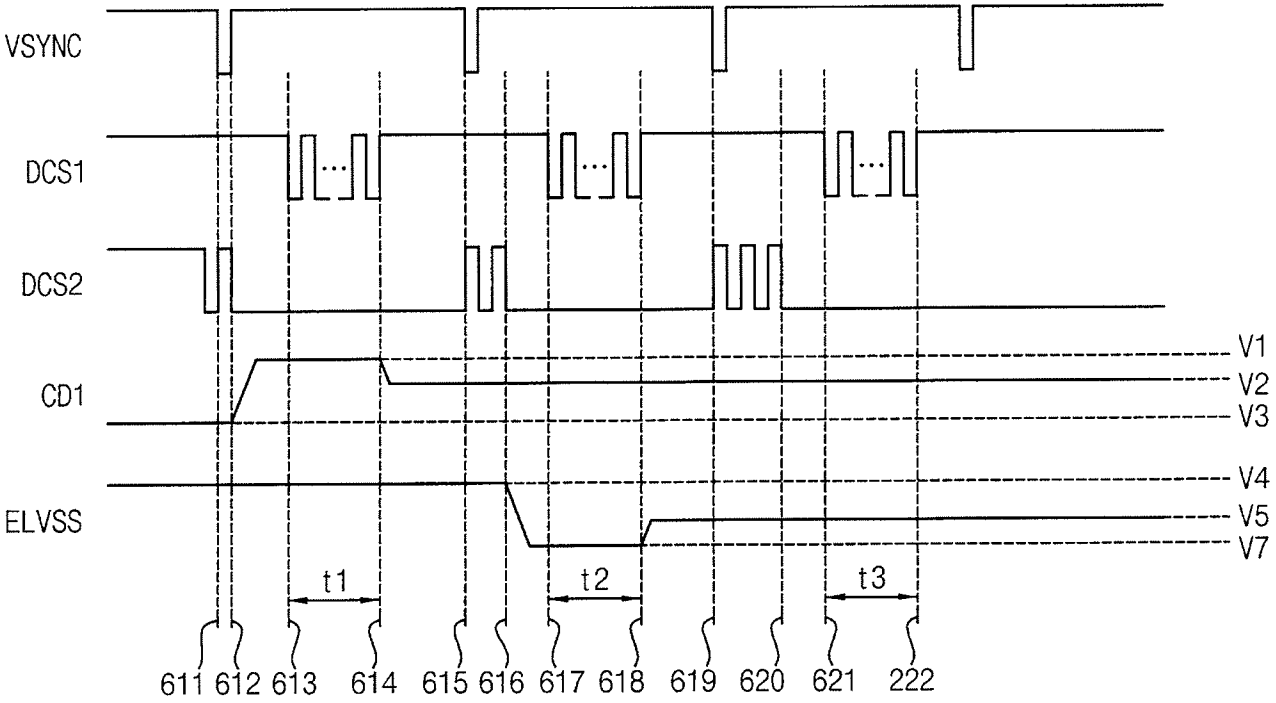
FIG. 6 illustrates another embodiment of a timing diagram for controlling DC voltages of the display device.

FIG. 6 illustrates another embodiment of a timing diagram for modifying levels of the first and second DC voltages of the display device 100 of FIG. 1, and another example procedure for enabling the first and second DC voltage conversion circuits included in the display device of FIG. 1.

Referring to FIG. 6, the first DC voltage conversion circuit 141 may modify the level of the first DC voltage CD1 based on a pulse number of continuous pulses the first conversion control signal DCS1 when continuous N pulses (N is a natural number) are provided as the second conversion control signal DCS2. The second DC voltage conversion circuit 142 may modify the level of the negative driving voltage ELVSS based on the pulse number of the continuous pulses in the first conversion control signal DCS1 when continuous M pulses (M is a natural number but N) are provided as the second conversion control signal DCS2. The second DC voltage conversion circuit 142 may extract a command signal of the second DC voltage conversion circuit 142 from the pulse number of the continuous pulses in the first conversion control signal DCS1 when continuous P pulses (P is a natural number but N, M) are provided as the second conversion control signal DCS2.

FIG. 6 describes a case where N is 1, M is 2, and P is 3. The values of N, M, and P are different natural numbers. In other embodiments, the values of N, M, and P may be different.

One pulse may be provided as the second conversion control signal DCS2 from the first time point 611 (e.g., a falling edge of the vertical synchronization signal VSYNC) to the second time point 612. At the second time point 612, the DC voltage converter 140 may enable the first DC voltage conversion circuit 141. For a certain time from the second time point 612, the first DC voltage conversion circuit 141 may increase the level of the first DC voltage CD1 from the third voltage level V3 to the first voltage level V1.

Because the one pulse is provided as the second conversion control signal DCS2, the first DC voltage conversion circuit 141 may decrease the level of the first DC voltage CD1 from the first voltage level V1 to the second voltage level V2 based on a pulse number of continuous pulses in the first conversion control signal DCS1 within a first period t1, which is from the third time point 613 to the fourth time point 614.

Two pulses may be provided as the second conversion control signal DCS2 from the fifth time point 615 (e.g., a falling edge of the vertical synchronization signal VSYNC) to the sixth time point 616. At the sixth time point 616, the DC voltage converter 140 may enable the second DC voltage conversion circuit 142. For a certain time from the sixth time point 616, the second DC voltage conversion circuit 142 may decrease the level of the negative driving voltage ELVSS from the fourth voltage level V4 to the seventh voltage level V7.

Because the two pulses are provided as the second conversion control signal DCS2, the second DC voltage conversion circuit 142 may increase the level of the negative driving voltage ELVSS from the seventh voltage level V7 to the fifth voltage level V5 based on a pulse number of continuous pulses in the first conversion control signal DCS1 within a second period t2, which is from the seventh time point 617 to the eighth time point 618.

Three pulses may be provided as the second conversion control signal DCS2 from the ninth time point 619 (e.g., a falling edge of the vertical synchronization signal VSYNC) to the tenth time point 620. Because the three pulses are provided as the second conversion control signal DCS2, the second DC voltage conversion circuit 142 may extract a command signal of the second DC voltage conversion circuit 142 from a pulse number of continuous pulses in the first conversion control signal DCS1 within a third period t3, which is from the eleventh time point 621 to the twelfth time point 622.

Figure 7:
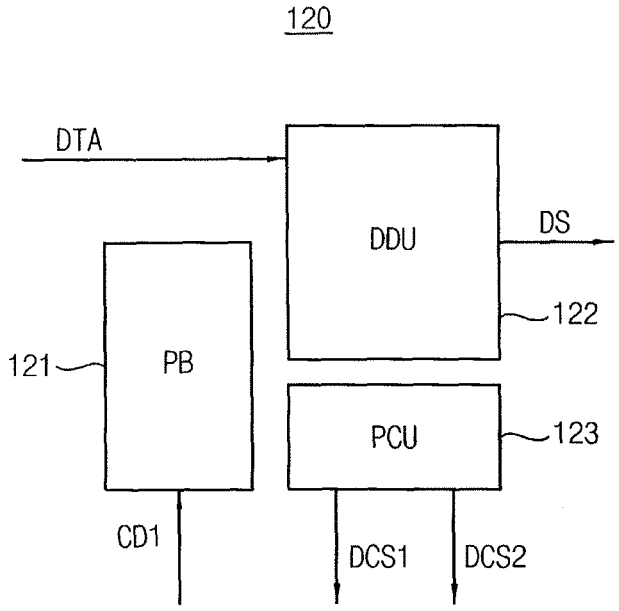
FIG. 7 illustrates an embodiment of a driving circuit in the display device.

FIG. 7 illustrates an embodiment of a driving circuit, which, for example, may be driving circuit 120 in the display device 100 of FIG. 1. Referring to FIG. 7, the driving circuit 120 includes a data driver DDU 122, a power block PB 121, and a power controller PCU 123. The data driver 122 may generate the driven signal DS based on the data signal DTA. The power block 121 may provide power to the driving circuit 120 based the first DC voltage CD1. The power controller 123 may generate the first and second conversion control signals DCS1, DCS2 reducing or minimizing power consumption of the display device 100 based on the characteristic variation of the display panel 130, a temperature of the display panel 130, and/or a luminance of the display panel 130.

Figure 8:
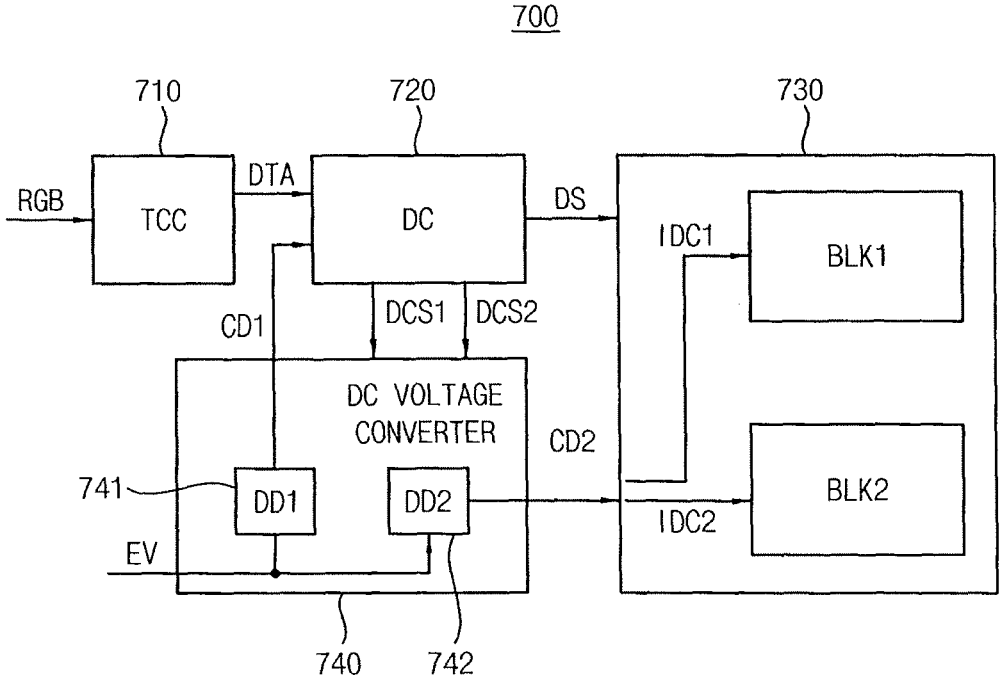
FIG. 8 illustrates another embodiment of a display device including a DC voltage conversion circuit according to an example embodiment.

FIG. 8 illustrates another embodiment of a display device 700 including a DC voltage converter. Referring to FIG. 8, the display device 700 includes a timing control circuit TCC 710, a driving circuit DC 720, a display panel 730, and a DC voltage converter 740. The DC voltage converter 740 includes a first DC voltage conversion circuit DD1 741, and a second DC voltage conversion circuit DD2 742. The display panel 730 includes a first block BLK1 and a second block BLK2. The second DC voltage CD2 includes a first internal DC voltage IDC1, which is provided to the first block BLK1, and a second internal DC voltage IDC2, which is provided to the second block BLK2.

The first internal DC voltage IDC1 includes a first positive driving voltage ELVDD1 and a first negative driving voltage ELVSS1. The second internal DC voltage IDC2 includes a second positive driving voltage ELVDD2 and a second negative driving voltage ELVSS2.

The timing control circuit 710 generates a data signal DTA based on an image signal RGB. The driving circuit 720 generates a first conversion control signal DCS1, and a second conversion control signal DCS2 representing a status of the first conversion control signal DCS1. The driving circuit 720 generates a driven signal DS based on the data signal DTA. The driving circuit 720 is powered by the first DC voltage CD1.

The first DC voltage conversion circuit DD1 generates a first DC voltage CD1 based an external voltage EV. The second DC voltage conversion circuit DD2 generates a second DC voltage CD2 based on the external voltage EV. The DC voltage converter 740 executes a time-shared control of the first and second DC voltage conversion circuits DD1, DD2 in response to the first and second conversion control signals DCS1, DCS2.

In other words, at a certain time, the DC voltage converter 740 may control the first DC voltage conversion circuit DD1 in response to the first and second conversion control signals DCS1, DCS2, or may control the second DC voltage conversion circuit DD2 in response to the first and second conversion control signals DCS1, DCS2. The DC voltage converter 740 may not control the first and second DC voltage conversion circuits DD1, DD2 in response to the first and second conversion control signals DCS1, DCS2 at the same time.

Figure 9:
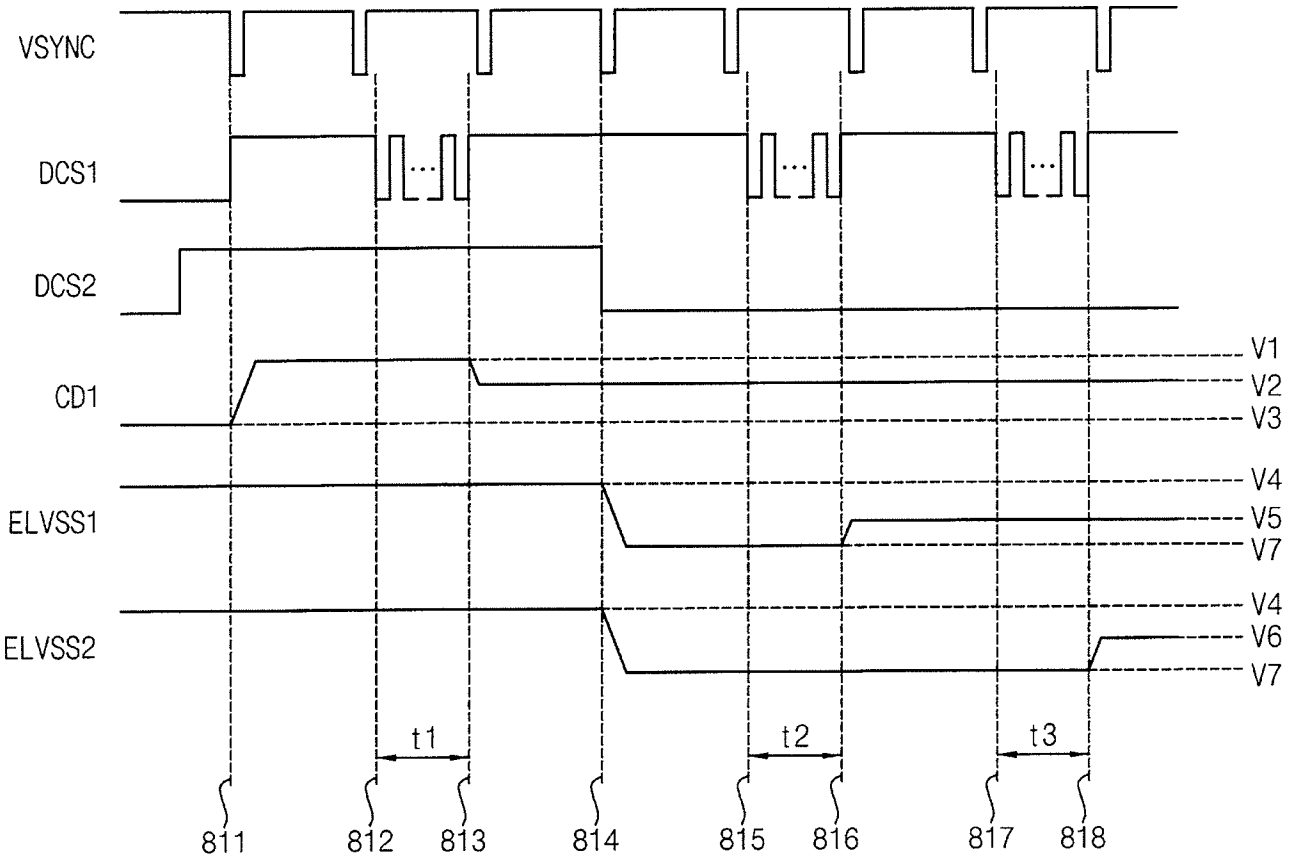
FIG. 9 illustrates an embodiment of a timing diagram for controlling DC voltages of the display device in FIG. 8.
Figure 10:
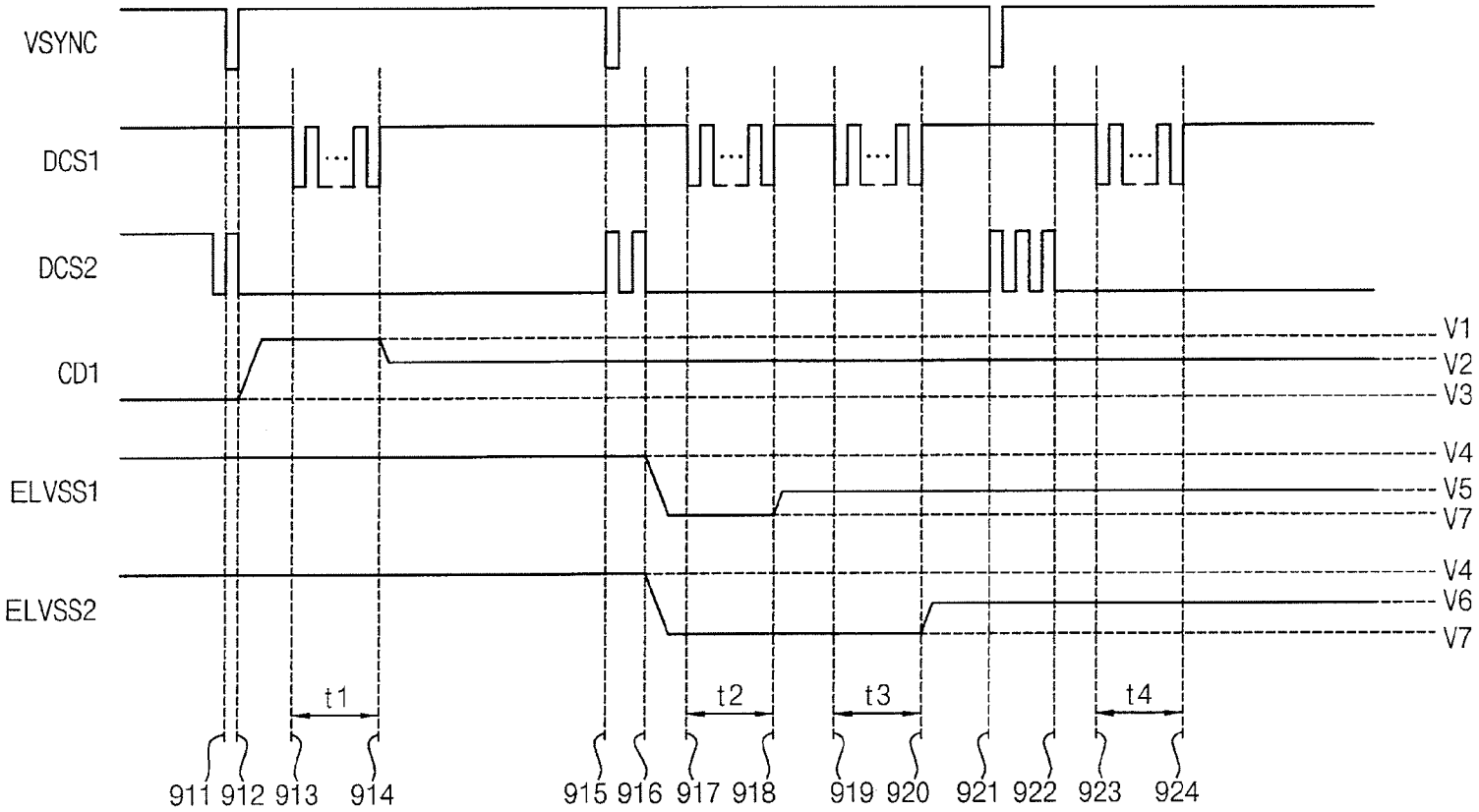
FIG. 10 illustrates another embodiment of a timing diagram for controlling DC voltages of the display device in FIG. 8.

FIGS. 9 and 10 illustrate an embodiment for operating the DC voltage converter 740. FIG. 9 is an embodiment of a timing diagram for modifying levels of the first and second DC voltages of the display device of FIG. 8, and an example procedure for enabling the first and second DC voltage conversion circuits in the display device 700 of FIG. 8.

Referring to FIG. 9, at a first time point 811 (e.g., a falling edge of the vertical synchronization signal VSYNC), the second conversion control signal DCS2 maintains an activation level, the first conversion control signal DCS1 transfers from a deactivation level to the activation level, and the DC voltage converter 740 enables the first DC voltage conversion circuit 741. For a certain time from the first time point 811, the first DC conversion circuit 741 increases a level of the first DC voltage CD1 from the third voltage level V3 to the first voltage level V1.

A first period t1 is from a second time point 812 to a third time point 813. The first DC voltage conversion circuit 741 modifies a level of the first DC voltage CD1 based on a pulse number of first continuous pulses in the first conversion control signal DCS1 within the first period t1, when the second conversion control signal DCS2 is activated.

When a voltage level corresponding to the pulse number of the first continuous pulses is the second voltage level V2, for a certain time from the third time point 813, the first DC conversion circuit 741 may decrease the level of the first DC voltage CD1 from the first voltage level V1 to the second voltage level V2.

At a fourth time point 814 (e.g., a falling edge of the vertical synchronization signal VSYNC), the first conversion control signal DCS1 maintains the activation level and the second conversion control signal DCS2 transfers from the activation level to the deactivation level. The DC voltage converter 740 enables the second DC voltage conversion circuit 742. For a certain time from the fourth time point 814, the second DC voltage conversion circuit 742 decreases a level of the first negative driving voltage ELVSS1 from the fourth voltage level V4 to the seventh voltage level V7, and may decrease a level of the second negative driving voltage ELVSS2 from the fourth voltage level V4 to the seventh voltage level V7.

Operation of the first and second positive driving voltages ELVDD1, ELVDD2 may be understood based on the operation of the first and second negative driving voltages ELVSS1, ELVSS2.

A second period t2 is from a fifth time point 815 to a sixth time point 816. The second DC voltage conversion circuit 742 modifies the level of the first negative driving voltage ELVSS1 based on a pulse number of second continuous pulses in the first conversion control signal DCS1 within the second period t2, when the second conversion control signal DCS2 is deactivated.

When a voltage level corresponding to the pulse number of the second continuous pulses is the fifth voltage level V5, for a certain time from the sixth time point 816, the second DC conversion circuit 742 increases the level of the first negative driving voltage ELVSS1 from the seventh voltage level V7 to the fifth voltage level V5.

A third period t3 is from a seventh time point 817 to a eighth time point 818. The second DC voltage conversion circuit 742 modifies the level of the second negative driving voltage ELVSS2 based on a pulse number of third continuous pulses in the first conversion control signal DCS1 within the third period t3, when the second conversion control signal DCS2 is deactivated.

When a voltage level corresponding to the pulse number of the third continuous pulses is the sixth voltage level V6, for a certain time from the eighth time point 818, the second DC conversion circuit 742 increases the level of the second negative driving voltage ELVSS2 from the seventh voltage level V7 to the sixth voltage level V6.

FIG. 10 illustrates another embodiment of a timing diagram for modifying levels of the first and second DC voltages of the display device 700 in FIG. 8, and another example procedure of enabling the first and second DC voltage conversion circuits included in the display device 700 in FIG. 8.

Referring to FIG. 10, the first DC voltage conversion circuit 741 modifies the level of the first DC voltage CD1 based on a pulse number of continuous pulses in the first conversion control signal DCS1, when continuous N pulses (N is a natural number) are provided as the second conversion control signal DCS2. The second DC voltage conversion circuit 742 modifies the level of the first negative driving voltage ELVSS1 and the level of the second negative driving voltage ELVSS2 based on the pulse number of the continuous pulses in the first conversion control signal DCS1, when continuous M pulses (M is a natural number but N) are provided as the second conversion control signal DCS2. The second DC voltage conversion circuit 742 extracts a command signal of the second DC voltage conversion circuit 742 from the pulse number of the continuous pulses in the first conversion control signal DCS1, when continuous P pulses (P is a natural number but N, M) are provided as the second conversion control signal DCS2.

FIG. 10 illustrates a case where N is 1, M is 2, and P is 3. The values of N, M, and P are different natural numbers, and may have different values in other embodiments.

One pulse may be provided as the second conversion control signal DCS2 from the first time point 911 (e.g., a falling edge of the vertical synchronization signal VSYNC) to the second time point 912. At the second time point 912, the DC voltage converter 740 may enable the first DC voltage conversion circuit 741. For a certain time from the second time point 912, the first DC voltage conversion circuit 741 may increase the level of the first DC voltage CD1 from the third voltage level V3 to the first voltage level V1.

Because the one pulse is provided as the second conversion control signal DCS2, the first DC voltage conversion circuit 741 may decrease the level of the first DC voltage CD1 from the first voltage level V1 to the second voltage level V2 based on a pulse number of continuous pulses in the first conversion control signal DCS1 within a first period t1, which is from the third time point 913 to the fourth time point 914.

Two pulses may be provided as the second conversion control signal DCS2 from the fifth time point 915 (e.g., a falling edge of the vertical synchronization signal VSYNC) to the sixth time point 916. At the sixth time point 916, the DC voltage converter 740 enables the second DC voltage conversion circuit 742. For a certain time from the sixth time point 916, the second DC voltage conversion circuit 742 decreases the level of the first negative driving voltage ELVSS1 from the fourth voltage level V4 to the seventh voltage level V7, and may decrease the level of the second negative driving voltage ELVSS2 from the fourth voltage level V4 to the seventh voltage level V7.

Because the two pulses are provided as the second conversion control signal DCS2, the second DC voltage conversion circuit 742 increases the level of the first negative driving voltage ELVSS1 from the seventh voltage level V7 to the fifth voltage level V5 based on a pulse number of continuous pulses in the first conversion control signal DCS1 within a second period t2, which is from the seventh time point 917 to the eighth time point 918.

Because the two pulses are provided as the second conversion control signal DCS2, the second DC voltage conversion circuit 742 increases the level of the second negative driving voltage ELVSS2 from the seventh voltage level V7 to the sixth voltage level V6 based on a pulse number of continuous pulses in the first conversion control signal DCS1 within a third period t3, which is from the ninth time point 919 to the tenth time point 920.

Three pulses may be provided as the second conversion control signal DCS2 from the eleventh time point 921 (e.g., a falling edge of the vertical synchronization signal VSYNC) to the twelfth time point 922. Because the three pulses are provided as the second conversion control signal DCS2, the second DC voltage conversion circuit 742 may extract a command signal of the second DC voltage conversion circuit 742 from a pulse number of continuous pulses in the first conversion control signal DCS1 within a fourth period t4, which is from the thirteenth time point 923 to the fourteenth time point 924.

Figure 11:
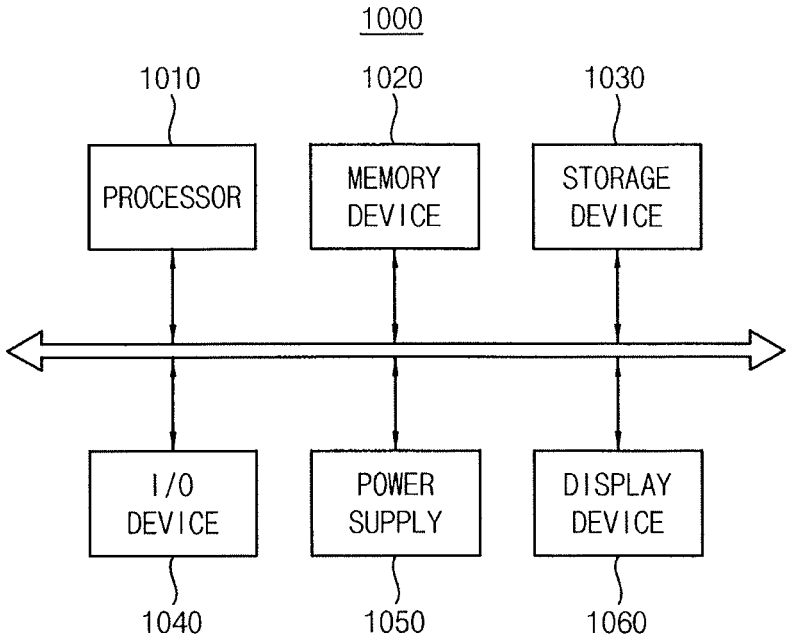
FIG. 11 illustrates an embodiment of an electronic device.

FIG. 11 illustrates an embodiment of an electronic device 1000 which includes a display device. Referring to FIG. 11, the electronic device 1000 includes a processor 1010, a memory device 1020, a storage device 1030, an input/output (I/O) device 1040, a power supply 1050, and a display device 1060. The electronic device 1000 may further include one or more ports for communicating a video card, a sound card, a memory card, a universal serial bus (USB) device, and/or other electronic devices. Although the electronic device 1000 is implemented as a smart-phone, the electronic device 1000 may be another type of device in another embodiment.

The processor 1010 may perform various computing functions. The processor 1010 may be a micro processor, a central processing unit (CPU), etc. The processor 1010 may be coupled to other components via an address bus, a control bus, a data bus, etc. Further, the processor 1010 may be coupled to an extended bus such as a peripheral component interconnection (PCI) bus.

The memory device 1020 may store data for operations of the electronic device 1000. For example, the memory device 1020 may include at least one non-volatile memory device such as an erasable programmable read-only memory (EPROM) device, an electrically erasable programmable read-only memory (EEPROM) device, a flash memory device, a phase change random access memory (PRAM) device, a resistance random access memory (RRAM) device, a nano floating gate memory (NFGM) device, a polymer random access memory (PoRAM) device, a magnetic random access memory (MRAM) device, a ferroelectric random access memory (FRAM) device, etc, and/or at least one volatile memory device such as a dynamic random access memory (DRAM) device, a static random access memory (SRAM) device, a mobile DRAM device, etc.

The storage device 1030 may be a solid state drive (SSD) device, a hard disk drive (HDD) device, a CD-ROM device, etc. The I/O device 1040 may be an input device such as a keyboard, a keypad, a touchpad, a touch-screen, a mouse, etc., and an output device such as a printer, a speaker, etc. The power supply 1050 may provide a power for operations of the electronic device 1000. The display device 1060 may communicate with other components via the buses or other communication links.

The display device 1060 may be, for example, the display device 100 of FIG. 1 or the display device 700 of FIG. 8. The display devices 100, 300 may be understood based on the references to FIGS. 1 through 10.

The example embodiments may be applied to any electronic system 1000 having the display device 1060. For example, the present embodiments may be applied to the electronic system 1000 such as a digital or 3D television, a computer monitor, a home appliance, a laptop, a digital camera, a cellular phone, a smart phone, a personal digital assistant (PDA), a portable multimedia player (PMP), a MP3 player, a portable game console, a navigation system, a video phone, etc.

The present embodiments may be applied to the arbitrary display device having a DC voltage converter. For example, the present embodiments may be applied to a mobile phone, smart phone, laptop computer, tablet computer, personal digital assistant (PDA), portable multimedia player (PMP), digital camera, music player (e.g., a MP3 player), portable game console, the navigation, etc.

In accordance with one or more of the aforementioned embodiments, a display device is provided which executes stable operation against external noise by controlling the DC voltage converter based on a combination of a first conversion control signal and a second conversion control signal representing a status of the first conversion control signal. In addition, the display device may reduce or minimize power consumption of the display device because a command signal may be modified independently according to operation modes of the display device.

Example embodiments have been disclosed herein, and although specific terms are employed, they are used and are to be interpreted in a generic and descriptive sense only and not for purpose of limitation. In some instances, as would be apparent to one of skill in the art as of the filing of the present application, features, characteristics, and/or elements described in connection with a particular embodiment may be used singly or in combination with features, characteristics, and/or elements described in connection with other embodiments unless otherwise indicated. Accordingly, it will be understood by those of skill in the art that various changes in form and details may be made without departing from the spirit and scope of the present invention as set forth in the following claims.

What is claimed is:

1. A display device, comprising:

a timing control circuit to generate a data signal based on an image signal;

a driving circuit to generate a first conversion control signal and a second conversion control signal, the driving circuit to generate a driven signal based on the data signal, the driving circuit powered by a first DC voltage;

a display panel including a plurality of pixels operating based on the driven signal, the display panel powered by a second DC voltage including a first driving voltage and a second driving voltage, the first and second driving voltages having voltage levels different from that of the first DC voltage; and a DC voltage converter including a first DC voltage conversion circuit and a second DC voltage conversion circuit, the first DC voltage conversion circuit to generate the first DC voltage based on an external voltage, the second DC voltage conversion circuit to generate the second DC voltage based on the external voltage, the DC voltage converter to control of the first and second DC voltage conversion circuits based on the first and second conversion control signals being received from the driving circuit, wherein the first driving voltage of the second DC voltage is positive, and the second driving voltage of the second DC voltage is negative.

2. The display device as claimed in claim 1, wherein the first DC voltage conversion circuit is to modify a level of the first DC voltage based on a number of first continuous pulses in the first conversion control signal when the second conversion control signal is activated.

3. The display device as claimed in claim 2, wherein the second DC voltage conversion circuit is to modify a level of the second DC voltage based on a number of second continuous pulses in the first conversion control signal when the second conversion control signal is deactivated.

4. The display device as claimed in claim 3, wherein the second continuous pulses are leading continuous pulses in the first conversion control signal after deactivation of the second conversion control signal.

5. The display device as claimed in claim 3, wherein the second DC voltage conversion circuit is to extract a command signal of the second DC voltage conversion circuit from a number of third continuous pulses in the first conversion control signal when the second conversion control signal is deactivated.

6. The display device as claimed in claim 5, wherein the third continuous pulses are after the second continuous pulses.

7. The display device as claimed in claim 1, wherein the first DC voltage conversion circuit is to be enabled when the second conversion control signal maintains an activation level and the first conversion control signal transfers from a deactivation level to the activation level.

8. The display device as claimed in claim 1, wherein the second DC voltage conversion circuit is to be enabled when the first conversion control signal maintains an activation level and the second conversion control signal transfers from the activation level to a deactivation level.

9. The display device as claimed in claim 1, wherein the first DC voltage conversion circuit is to be disabled when the first conversion control signal maintains a deactivation level and the second conversion control signal maintains an activation level for a time after transition from the deactivation level to the activation level.

10. The display device as claimed in claim 1, wherein the second DC voltage conversion circuit is to be disabled when the second conversion control signal maintains a deactivation level and the first conversion control signal maintains the deactivation level for a time after transition from an activation level to the deactivation level.

11. The display device as claimed in claim 1, wherein the first DC voltage conversion circuit is to modify a level of the first DC voltage based on a number of continuous pulses the first conversion control signal when a predetermined number N of continuous pulses are provided as the second conversion control signal.

12. The display device as claimed in claim 11, wherein the second DC voltage conversion circuit is to modify a level of the second DC voltage based on the number of the continuous pulses in the first conversion control signal when a predetermined number M of continuous pulses are provided as the second conversion control signal.

13. The display device as claimed in claim 12, wherein the second DC voltage conversion circuit is to extract a command signal of the second DC voltage conversion circuit from the number of the continuous pulses in the first conversion control signal when a predetermined number P of continuous pulses are provided as the second conversion control signal, wherein P is different from predetermined numbers N and M.

14. The display device as claimed in claim 1, wherein each of the pixels includes an organic light emitting diode.

15. The display device as claimed in claim 1, wherein the driving circuit includes:

a data driver to generate the driven signal based on the data signal;

a power block to provide power to the driving circuit based on the first DC voltage; and a power controller to generate the first and second conversion control signals to reduce power consumption of the display device based on at least one of a characteristic variation of the display panel, a temperature of the display panel, or a luminance of the display panel.

16. A display device, comprising:

a timing control circuit to generate a data signal based on an image signal;

a driving circuit to generate a first conversion control signal and a second conversion control signal, the driving circuit to generate a driven signal based on the data signal, the driving circuit powered by a first DC voltage;

a display panel including a plurality of pixels operating based on the driven signal, the display panel powered by a second DC voltage; and a DC voltage converter including a first DC voltage conversion circuit and a second DC voltage conversion circuit, the first DC voltage conversion circuit to generate the first DC voltage based on an external voltage, the second DC voltage conversion circuit to generate the second DC voltage based on the external voltage, the DC voltage converter to control of the first and second DC voltage conversion circuits based on the first and second conversion control signals, wherein:

the display panel includes a first block and a second block, the second DC voltage includes a first internal DC voltage provided to the first block and a second internal DC voltage provided to the second block, and each of the first internal DC voltage and the second internal DC voltage includes a first driving voltage that is positive and a second driving voltage of the second DC voltage that is negative.

17. The display device as claimed in claim 16, wherein:

the first internal DC voltage includes a first positive driving voltage and a first negative driving voltage, the second internal DC voltage includes a second positive driving voltage and a second negative driving voltage.

18. The display device as claimed in claim 16, wherein the second DC voltage conversion circuit is to modify a level of the first internal DC voltage based on a number of first continuous pulses in the first conversion control signal and is to modify a level of the second internal DC voltage based on a number of second continuous pulses in the first conversion control signal when the second conversion control signal is deactivated.

19. The display device as claimed in claim 16, wherein the second DC voltage conversion circuit is to modify a level of the first internal DC voltage based on a number of first continuous pulses in the first conversion control signal and is to modify a level of the second internal DC voltage based on a number of second continuous pulses in the first conversion control signal when a predetermined number M of continuous pulses are provided as the second conversion control signal.

* * * * *